US006254119B1

(12) United States Patent
Bardin

(10) Patent No.: US 6,254,119 B1
(45) Date of Patent: Jul. 3, 2001

(54) SKI BRAKE

(75) Inventor: Roland Bardin, Varennes Vauzelles (FR)

(73) Assignee: Look Fixations S.A., Nevers (FR)

( * ) Notice: Subject to any disclaimer, the term of this patent is extended or adjusted under 35 U.S.C. 154(b) by 0 days.

(21) Appl. No.: 09/495,286

(22) Filed: Jan. 31, 2000

(30) Foreign Application Priority Data

Feb. 2, 1999 (FR) ..... 99 01327

(51) Int. Cl.[7] ..... A63C 7/10
(52) U.S. Cl. ..... 280/605
(58) Field of Search ..... 280/605, 604, 280/28.11

(56) References Cited

U.S. PATENT DOCUMENTS

| | | | | |
|---|---|---|---|---|
| 4,123,083 | | 10/1978 | Riedel . | |
| 4,135,728 | | 1/1979 | Salomon . | |
| 4,268,060 | * | 5/1981 | Svoboda | 280/605 |
| 4,279,432 | * | 7/1981 | Krob et al. | 280/605 |
| 4,355,817 | * | 10/1982 | Krob et al. | 280/605 |
| 4,708,360 | * | 11/1987 | Peyre | 280/605 |
| 5,033,766 | * | 7/1991 | Sedlmair et al. | 280/605 |

FOREIGN PATENT DOCUMENTS

| | | |
|---|---|---|
| 378 685 B | 9/1985 | (AT) . |
| 27 07 839 | 12/1986 | (DE) . |
| 2 554 110 | 3/1988 | (DE) . |
| 0 893 144 | 1/1999 | (EP) . |
| 2 322 627 | 4/1977 | (FR) . |
| 2 741 275 | 5/1997 | (FR) . |

OTHER PUBLICATIONS

U.S. application No. 08/748,555 Chevalier, filed Nov. 8, 1996.
U.S. application No. 09/118,534 Chonier.
French Premliminary Search Report in SN 9901327.

* cited by examiner

*Primary Examiner*—Michael Mar
(74) *Attorney, Agent, or Firm*—Bugnion S.A.; John Moetteli

(57) ABSTRACT

A ski brake consisting of a hoop (2) of spring metal articulated by its sides to a base (1) and having in its central part a flattened open loop (25) bearing on the base so as to form a return spring tending to hold the brake in the active position, the central part of the hoop carrying a pedal (3) fitted so as to tilt. The pedal has a protuberance (33) which engages in the open loop (25) when the brake is in the raised position. The pinching by the loop (25) on the protuberance lifts the pedal when the pressure on the latter is released.

2 Claims, 3 Drawing Sheets

SKI BRAKE

BACKGROUND OF THE INVENTION

The present invention relates to a ski brake consisting of a hoop of spring metal articulated transversely, by its sides, to a base and having, in its central part, a flattened open loop bearing on the base so as to form a return spring tending to hold the brake in the active braking position, the central part of the hoop further carrying a pedal fitted so as to tilt about the central part, this pedal being intended to receive the pressure of the boot so as to raise the brake against the action of the open loop.

Such a brake is substantially known from Patent DE 25 54 110, the content of which is incorporated by reference. Although the central part of the metal hoop is not actually fitted with a pedal in this embodiment, the addition of a pedal is nevertheless well known and has even become common practice. In particular, such a pedal is found in U.S. Pat. No. 4,135,728, the content of which is incorporated by reference.

The patent DE 27 07 839, the content of which is incorporated by reference, discloses a brake consisting essentially of a simple hoop fitted with a plastic plate forming an actuating pedal for raising the brake when putting the boot in the binding. When the brake is in the lowered position, this pedal remains in the plane of the metal hoop, that is to say in an oblique position which is less than ideal for supporting the sole of the boot. Further, in this embodiment, the brake is lowered into the active position by an auxiliary spring.

U.S. Pat. No. 4,135,728 discloses a brake fitted with a pedal which is raised into a horizontal position under the effect of a torsion spring, so as to place this pedal in a position favorable for its actuation by the boot.

Brakes are moreover known, such as the brake represented in U.S. patent application Ser. No. 09/118,534, the content of which is incorporated by reference and U.S. patent application Ser. No. 08/748,555, the content of which is incorporated by reference, comprising two separate brake arms articulated to a pedal which is further connected to the brake base by an auxiliary rod so as to form a parallelogram-type articulation holding the pedal in a substantially horizontal position. An auxiliary spring acts on the rod so as to lower the brake into the active position.

SUMMARY OF THE INVENTION

The object of the present invention, when used in a brake consisting of a single hoop of spring metal without any auxiliary spring for lowering it into the active position, is to lift the pedal into a substantially horizontal position without an auxiliary spring.

The brake according to the invention is one wherein the lower face of the pedal has a protuberance which has a wedge-like cross section which widens from its apex in the direction of its base and engages in the open loop of the hoop when the brake is in the raised position, this protuberance having the effect of elastically splaying the open loop when it is engaged in the loop, the loop's pinching on the protuberance having the effect, when the pressure on the pedal is released, of lifting the pedal at least partially.

Such a brake is extremely simple. It consists of a minimal number of parts, namely a metal hoop, a base and a pedal, the base and the pedal being preferably made of injection-molded plastic. The ends of the metal hoop are preferably covered in plastic to make them safer, as is the case with all modem brakes.

BRIEF DESCRIPTION OF THE DRAWINGS

The appended drawing represents an embodiment of the brake according to the invention by way of example.

DETAILED DESCRIPTION OF THE PREFERRED EMBODIMENTS

Figure 1:
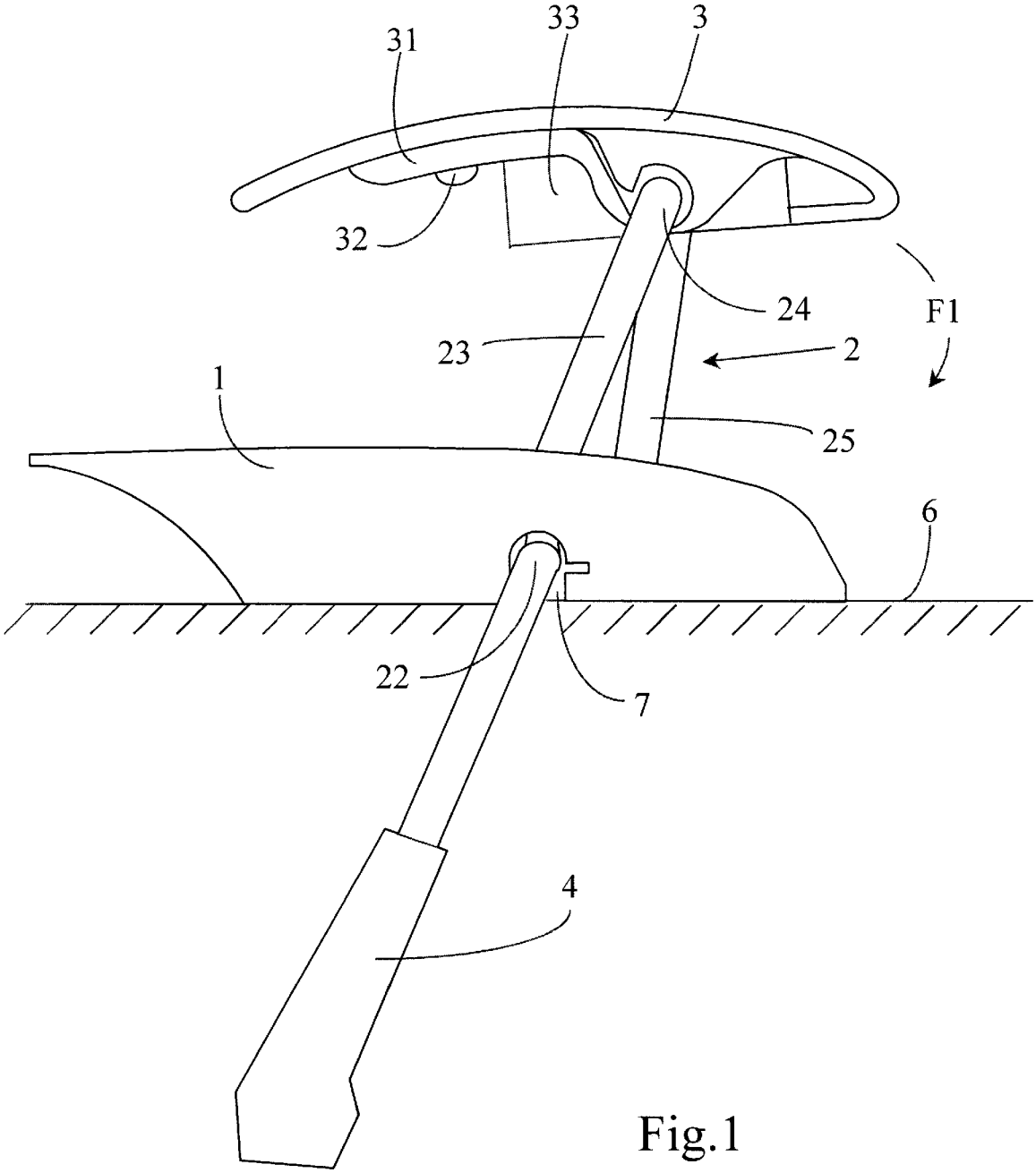
FIG. 1 represents a side view of the invention.

The brake represented consists of three parts, namely a plastic base 1, a hoop 2 of material acting as a spring, for example steel, and a plastic pedal 3, to which parts the plastic covers 4 and 5 of the ends of the arms 21 of the hoop 2 must be added.

The base 1 is fixed to a ski 6 using screws.

In the known way, the hoop 2 has a double bend on each side, level with the base 1, these double bends defining two mutually aligned horizontal sections 22 forming the axis about which the brake is articulated in the base 1, which has two notches 7 for this purpose (FIGS. 1 and 3) forming bearings for the sections 22 of the hoop 2. Above the base, the hoop 2 has two diverging symmetrical oblique sections 23 used, in the known way, to bring the arms 21 together when the brake is raised by these sections 23 pressing on the base 1. In its upper part, the hoop 2 has two more mutually aligned horizontal straight sections 24 used as an articulation axis for the pedal 3. Lastly, the central part of the hoop 2 forms an open loop 25 having transverse sections 25*a* and 25*b* directed downwards and a lower section 25*c* bearing on a plane face of the base 1 on which it can slide. As can be seen in FIG. 1, the plane of the open loop 25 is inclined relative to the vertical in the same sense as the plane of the sections 23, but with a steeper gradient, forming an acute angle with the plane of the sections 23. When the brake is fitted, the open loop 25 holds the hoop 2 in the base 1.

The pedal 3 is held on the hoop 2 by two tongues 31 which pass over the straight sections 24 of the hoop 2 and are latched on two studs 32 of the pedal. On its lower face, that is to say on the same side as the tongues 31, the pedal 3 has a protuberance which, in the example represented, consists of a central longitudinal rib 33 extending along the symmetry axis of the pedal and having a trapezoidal cross section as can be seen in FIG. 2.

Figure 2:
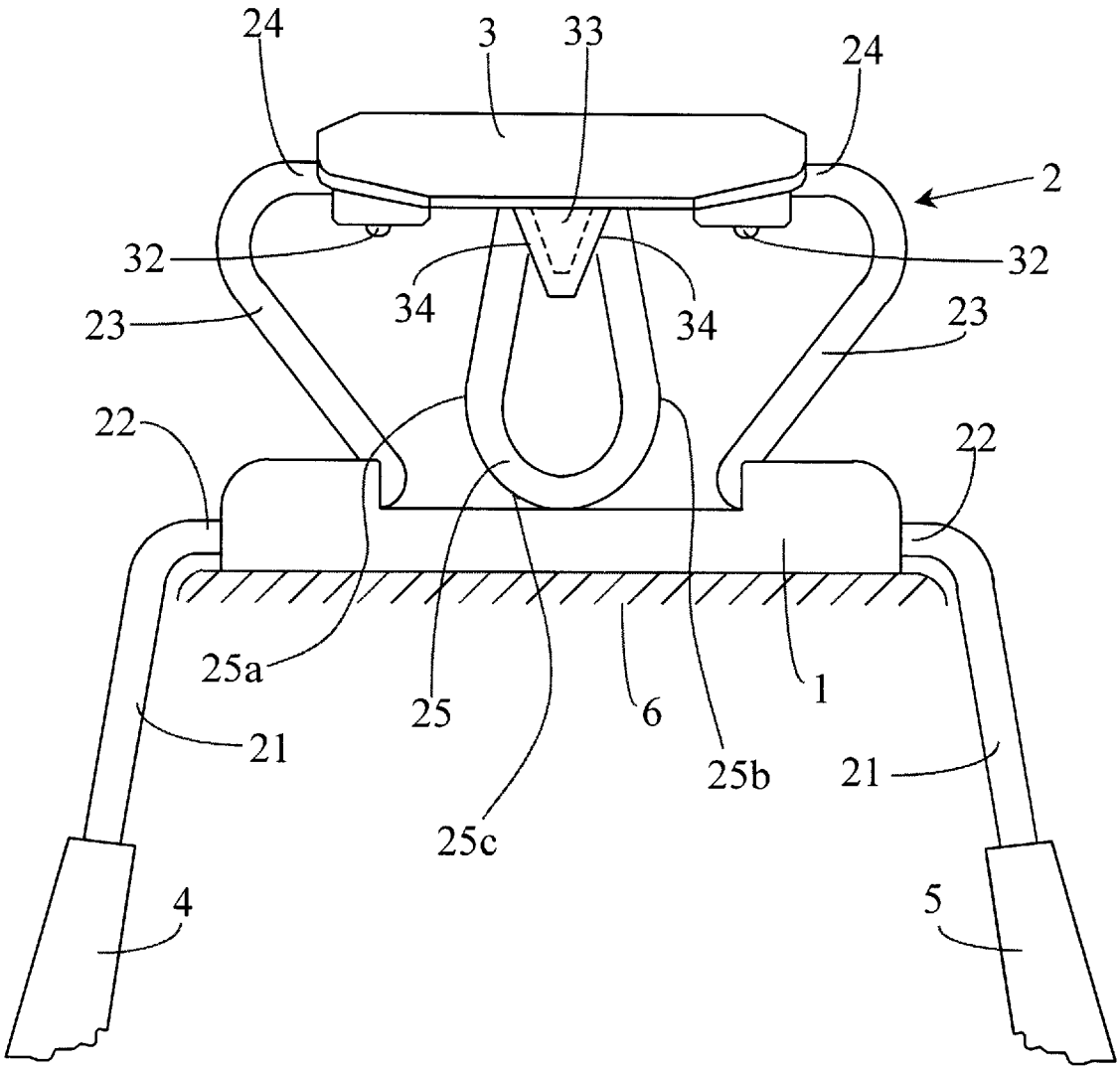
FIG. 2 is a back view of the invention, that is to say seen from the rear of the ski in the direction of the front.
Figure 3:
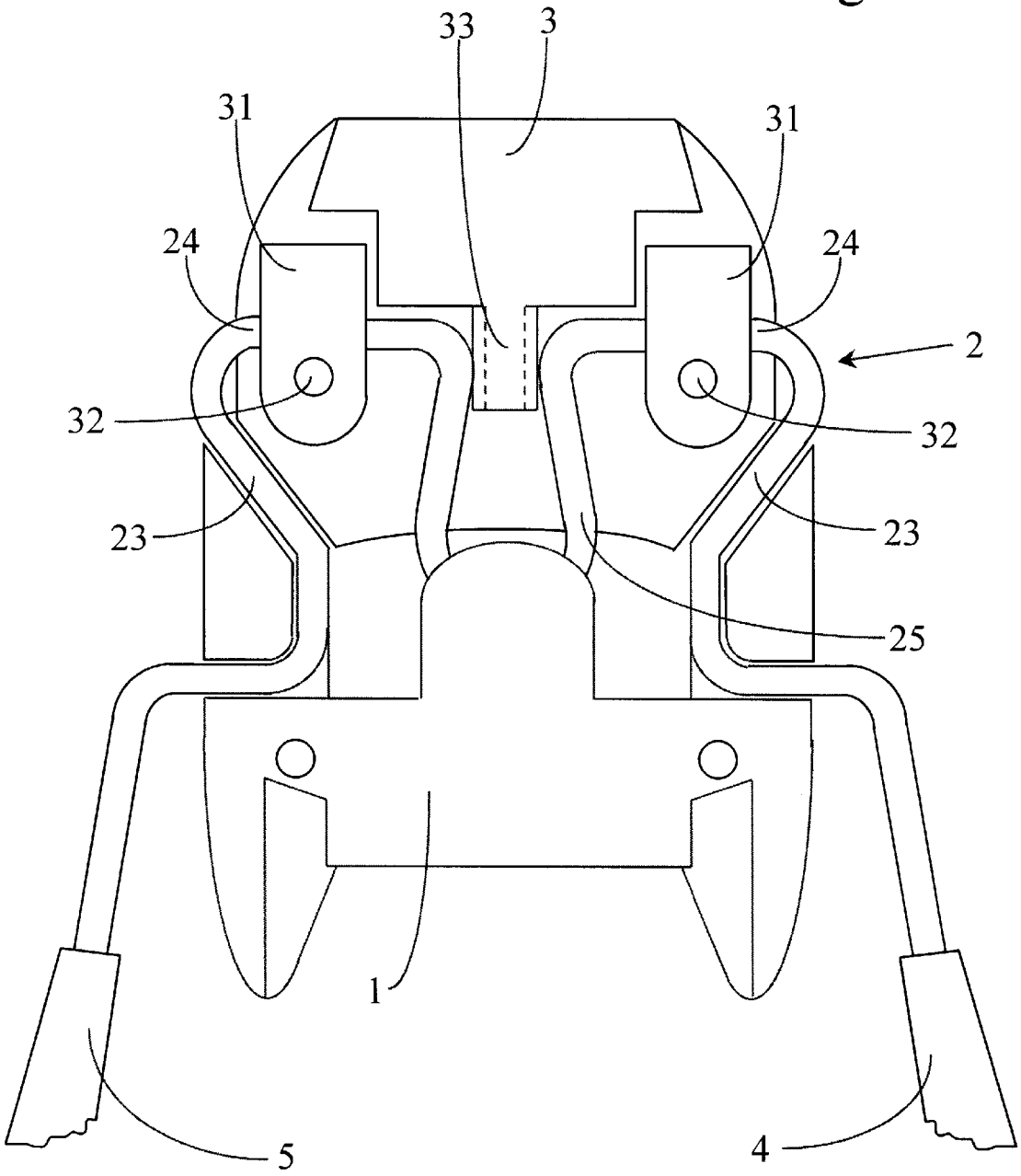
FIG. 3 represents the brake seen from below, in the raised position due to the pressure of a boot, but without the ski.

FIGS. 1 and 2 represent the brake in the active lowered position, that is to say in the absence of a boot. When pressure is exerted by the boot on the pedal 3, this pressure tends to rotate the hoop of the brake in the sense of the arrow F1, FIG. 1, that is to say to raise the brake into the inoperative position. During this motion, the plane containing the open loop 25 moves toward the plane containing the sections 23 because of the bracing against the base and sliding of the loop 25 on the base. This movement is accompanied by a twisting deformation of the hoop 2 in the sections 24, the effect of which twisting is to strongly prime the spring formed by this hoop. In addition, the pedal 3 drops substantially into the plane of the sections 23, that is to say into the plane of the hoop as represented in FIG. 3. During this dropping, the protuberance 33 enters between the side portions 25*a* and 26*b* of the open loop 25, or more precisely the opening of this loop. The slopes 34 formed by the sides of the protuberance 33 tend to splay or open the loop 25, hence creating, on the loop 25, a second stress oriented in the plane of this loop. This splaying of the loop 25 is accompanied by a bringing together or merging toward one another of the arms 21, which bringing together is favorable because these arms need to be brought as far as possible into the width of the ski so as not to interfere with setting the edges when skiing downhill.

When the boot is removed from the binding, intentionally or in the event of a fall, the hoop of the brake returns to the position represented in FIGS. 1 and 2 under the pushing action of the open loop 25. Since the loop 25 is also pressed apart by the protuberance 33, it pinches this protuberance firmly. This pinching acts on the slopes 34, and generates a component force which tends to push the protuberance 33 out of the loop 25, so that the pedal 3 lifts to resume the position represented in FIGS. 1 and 2. If the plastic forming the pedal 3 has a non-negligible coefficient of friction, the pedal does not lift immediately, and this lifting may take one or two seconds, which is not a problem. The harder the plastic is, the faster the lifting will be.

The protuberance 33 could have a different shape, for example a spherical cap shape or a conical or frustoconical shape, or any other shape capable of splaying the loop 25 to generate an expelling reaction, that is to say a cross section which widens from its apex in the direction of its base. The protuberance could be formed by a separate attached part, made of a material different than the material of the pedal. The protuberance could be covered with a material with a low coefficient of friction and sufficient hardness, for example in the form of a cap.

Although illustrative embodiments of the invention have been shown and described, a wide range of modification, change and substitution is contemplated in the foregoing disclosure and in some instances; some features of the present invention may be employed without a corresponding use of the other features. Accordingly, it is appropriate that the appended claims be construed broadly and in a manner consistent with the scope of the invention.

What is claimed is:

1. A ski brake having a formed resilient structure (2) having, in its central region, a loop (25) formed substantially in a first plane and having side portions **(25*a*, 25*b*) spaced-apart so as to define a gap and a lower portion which bears on the base, the side portions each resiliently connecting to a transverse rod (24) onto which a pedal (3) is pivotally mounted, the transverse rods each connecting to a lateral arm (23) which is formed substantially in a second lane with and is substantially perpendicular to the transverse rod (24), the lateral arms (23) each extending to a distal end forming a brake arm (21), the lateral arms being pivotally connected to the base (1) at a central portion (22) about a transverse axis to the base, the first and second plane being coaxial with the transverse rods (24), the angular offset so chosen so as to form a return spring in which the loop (25) bears against the base, thus biasing the brake arms (21) in the active lowered position, the pedal (3) reacting against pressure exerted by the boot so as to raise the brake against the action of the loop, wherein the lower face of the pedal has a protuberance (33) which has a wedge-shaped cross section which engages in the gap a distance from the pivot axis of the pedal, this protuberance having the effect of elastically splaying the loop (25)** when urged into the gap, the loop's pinching on inclined surfaces of the protuberance having the effect, when the pressure on the pedal is released, of lifting the pedal at least partially.

2. The ski brake as claimed in claim 1, wherein the protuberance (33) is in the form of a longitudinal rib with trapezoidal or V-shaped cross section.

* * * * *